US010183787B2

(12) United States Patent
Camacho Paredes et al.

(10) Patent No.: US 10,183,787 B2
(45) Date of Patent: Jan. 22, 2019

(54) CROWN-TYPE METAL CAP FOR SEALING A METAL BOTTLE

(71) Applicant: FÁBRICAS MONTERREY, S. A. DE C. V., Monterrey (MX)

(72) Inventors: Juan Antonio Camacho Paredes, Monterrey (MX); Gilberto Robles González, Monterrey (MX)

(73) Assignee: Fabricas Monterrey, S.A. DE C.V. (MX)

( * ) Notice: Subject to any disclaimer, the term of this patent is extended or adjusted under 35 U.S.C. 154(b) by 0 days.

(21) Appl. No.: 14/429,320

(22) PCT Filed: Sep. 18, 2013

(86) PCT No.: PCT/MX2013/000106
§ 371 (c)(1),
(2) Date: Mar. 18, 2015

(87) PCT Pub. No.: WO2014/046532
PCT Pub. Date: Mar. 27, 2014

(65) Prior Publication Data

US 2015/0232236 A1 Aug. 20, 2015

(30) Foreign Application Priority Data

Sep. 18, 2012 (MX) ..... MX/a/2012/010782

(51) Int. Cl.
*B65D 41/00* (2006.01)
*B65D 41/12* (2006.01)
*B65D 53/02* (2006.01)

(52) U.S. Cl.
CPC ..... *B65D 41/125* (2013.01); *B65D 53/02* (2013.01)

(58) Field of Classification Search
CPC .. B65D 41/045; B65D 41/0457; B65D 41/10; B65D 41/12; B65D 41/125; B65D 41/14; B65D 41/145
USPC ..... 215/345, 324, 328
See application file for complete search history.

(56) References Cited

U.S. PATENT DOCUMENTS 2,829,790 A * 4/1958 Iscle-Aregger ..... B65D 41/12 215/250
3,092,280 A * 6/1963 Ford ..... B21D 51/48 215/328
3,171,560 A * 3/1965 Desch ..... B65D 41/12 215/328

(Continued)

FOREIGN PATENT DOCUMENTS

EP 1095869 A1 5/2001
GB 783245 A 9/1957
WO WO 03/074383 A1 9/2003

*Primary Examiner* — Ernesto Grano
(74) *Attorney, Agent, or Firm* — Baker & Hostetler LLP

(57) ABSTRACT

A crown-type metal cap for sealing the mouth of a preferably aluminum metal bottle, the cap being formed by a laminar part of circular plan form, including an inner face and an outer face and provided peripherally with a closure skirt and, on the inner face, with a closure gasket including a peripheral lip. The cross-section of the peripheral lip is formed by a convex arc having at least one radius of curvature, adjacent to the closure skirt, the lip also including a side opposite the closing skirt, which can be a straight side or a curved side having a radius of curvature greater than that of the convex arc.

25 Claims, 8 Drawing Sheets

(56) References Cited

U.S. PATENT DOCUMENTS 3,257,021 A * 6/1966 Brockett ..... B65D 41/12 156/240
3,273,736 A * 9/1966 Lister et al. ..... B65D 41/12 215/352
3,300,072 A * 1/1967 Caviglia ..... B65D 41/12 215/345
3,302,811 A * 2/1967 Kosar ..... B65D 41/12 215/328
3,325,035 A * 6/1967 Strickman ..... B29C 31/048 215/348
3,339,774 A * 9/1967 Rainer ..... B29C 44/022 215/230
3,450,291 A * 6/1969 Lovell ..... B65D 51/243 215/305
3,547,746 A * 12/1970 Gwinner ..... B29C 43/18 215/230
3,581,690 A * 6/1971 Zapata ..... B65D 41/12 413/19
3,633,781 A * 1/1972 Zapata ..... B65D 41/12 215/328
3,696,956 A * 10/1972 Merrill ..... B65D 53/00 215/343
4,111,323 A * 9/1978 Ichinose ..... B65D 41/12 215/228
4,128,185 A * 12/1978 Wszolek ..... B65D 41/12 215/349
4,157,143 A * 6/1979 Doi ..... B65D 41/12 215/228
4,269,321 A * 5/1981 Ichinose ..... B32B 7/06 215/230
4,310,100 A * 1/1982 Kunimoto ..... B65D 53/00 215/228
4,337,871 A * 7/1982 Tucker ..... B65D 41/12 215/328
4,372,457 A * 2/1983 Kunimoto ..... B65D 53/00 215/228
4,395,446 A 7/1983 Kunimoto et al.
6,006,933 A * 12/1999 Henning ..... B65D 41/12 215/326
6,478,174 B1 * 11/2002 Grazia ..... B65D 41/12 215/277
8,550,271 B2 * 10/2013 Merino Caballero . B65D 53/04 215/324
2005/0067367 A1 * 3/2005 Carballido ..... B65D 41/125 215/324
2005/0167392 A1 * 8/2005 Martinez ..... B65D 41/12 215/341
2008/0110891 A1 * 5/2008 Carballido ..... B65D 41/125 220/309.1
2010/0264109 A1 * 10/2010 Garcia Pedraza ..... B65D 41/12 215/328
2010/0326949 A1 * 12/2010 Merino Caballero . B65D 53/04 215/316
2011/0168582 A1 7/2011 Bannister

* cited by examiner

CROWN-TYPE METAL CAP FOR SEALING A METAL BOTTLE

TECHNICAL FIELD OF THE INVENTION

The present invention relates to a crown-type metal cap for sealing bottles, particularly it relates to a crown-type metal cap for sealing the mouth of a metal bottle.

BACKGROUND OF THE INVENTION

At present, crown-type metal caps are formed by a laminar part of circular plan form having an inner face and an outer face, provided peripherally with a closure skirt and a closure gasket having a peripheral lip located on the inner side of the metal cap. The closure skirt is in turn provided with a plurality of radial projections and depressions interspersed while the peripheral lip of the closure gasket comprises one or more protrusions. These crown-type metal caps are used for sealing the mouth of a glass bottle containing a beverage, that may either be pressurized or not.

The crown-type metal cap to be applied to a glass bottle, offers a hermetic sealing, as the circular plan and the peripheral lip of the closure gasket are tight against the top ring of the mouth of the glass bottle when the cap is applied on it. The protrusions and depressions of the closure skirt of the crown-type metal cap are folded and pressed at the same time through a forming tooling against the ring of the mouth of the glass bottle and slightly below it, providing a proper grip.

The actual crown-type metal cap that is used to seal the mouth of a glass bottle is not suitable for sealing a mouth of a metal bottle, because the metal mouth of a bottle has a different configuration from the mouth of a glass bottle as shown in FIGS. 1, 2 and 3. The mouth of a glass bottle 10 shows a ring 11 having an external diameter D1 and an inner diameter D2 and a top rim 12 and inner rim 13 where at least one of these rims is flat, which helps the sealing by the appropriate seating of the peripheral lip of the closure gasket on said rims. In contrast, the mouth of a metal bottle 20 has a metal ring 21 having an outer diameter D3 and an inner diameter D4 and fully curved edge, so that the outer diameter D3 is generally equal to the inner diameter D1 of ring 11 of the glass bottle 10, while the inner diameter D4 is larger than the outer diameter D2 of ring 11 of the glass bottle 10.

In addition to this, the manufacturing process produces the mouth of the glass bottle to have a constant diameter and because of its material it has a strength that doesn't allow any deformation of the mouth during storage, transportation, filling and sealing of the glass bottle, which produces the proper seating and hermetic closure of the crown-type metal cap. The configuration of the mouth of the glass bottle is standardized by the "Glass Packaging Institute". In contrast, the mouth of the metal bottle tends to deform during its proper manufacturing process, as well as in storage, transportation, filling and sealing of the metal bottle, which means that the diameter of the bottle mouth presents variations or irregularities that can lead to a non-hermetic closure of the traditional crown-type metal cap.

Therefore, the current crown-type metal cap that is used to seal glass bottles is not entirely favorable to seal metal bottles, since the closure gasket of the current crown-type metal cap is not adapted to compensate for variations present in the finish and the diameter of the mouth of the metal bottle, thus it is necessary to provide a crown-type metal cap with a closure gasket having a design which compensates for such imperfections in the mouth of the metal bottle.

SUMMARY OF THE INVENTION

In view of the above and in order to solve the limitations encountered in the crown-type metal caps, it is the object of the invention to offer a crown-type metal cap to seal the mouth of a metal bottle; this crown-type metal cap is formed by a laminar piece with a circular inner surface and an outer surface, provided with a closure skirt and a closing gasket with a peripheral lip located on the inner surface; the peripheral lip has a convex arc with at least one radius of curvature and adjacent to the closure skirt, and an opposite side to the closure skirt and this has a shape selected from a group consisting of a straight line, a curve with a radius of curvature greater than the radius of curvature of the convex arc, and combinations thereof.

BRIEF DESCRIPTION OF THE FIGURES

The characteristic details of the invention are described in the following paragraphs together with the figures related to it, in order to define to the invention but without limiting its scope.

DETAILED DESCRIPTION OF THE INVENTION

The present invention refers to a crown-type metal cap useful for sealing the mouth of a metal bottle, where this metal bottle may be of aluminum or of any other type of metal appropriate to contain a pressurized or non-pressurized drink for human consumption.

Figure 1:
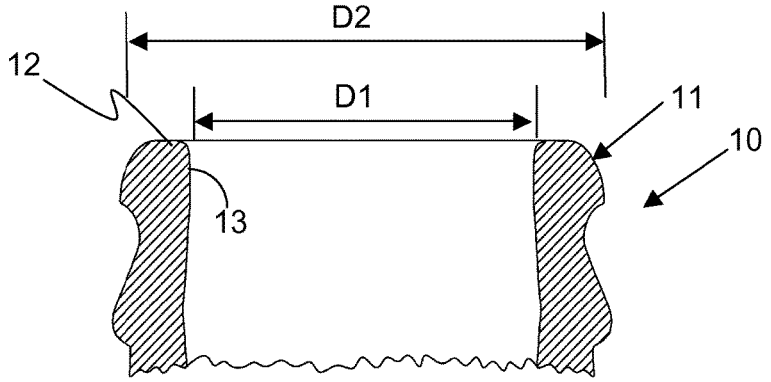
FIG. 1 shows a side sectional view of a mouth of a glass bottle of the prior art.
Figure 2:
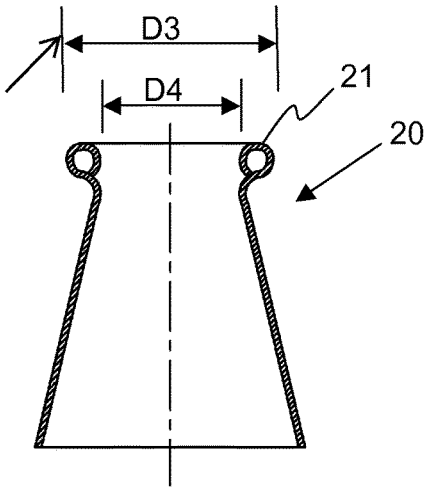
FIG. 2 shows a side sectional view of a first embodiment of the mouth folded into a metal bottle of the prior art.
Figure 3:
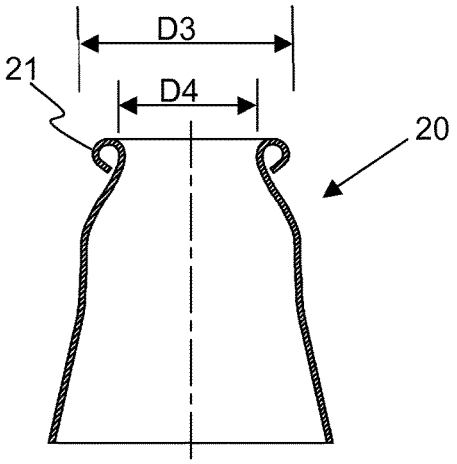
FIG. 3 shows a side sectional view of a second embodiment of the mouth folded onto the outer of a metal bottle of the prior art.
Figure 4:
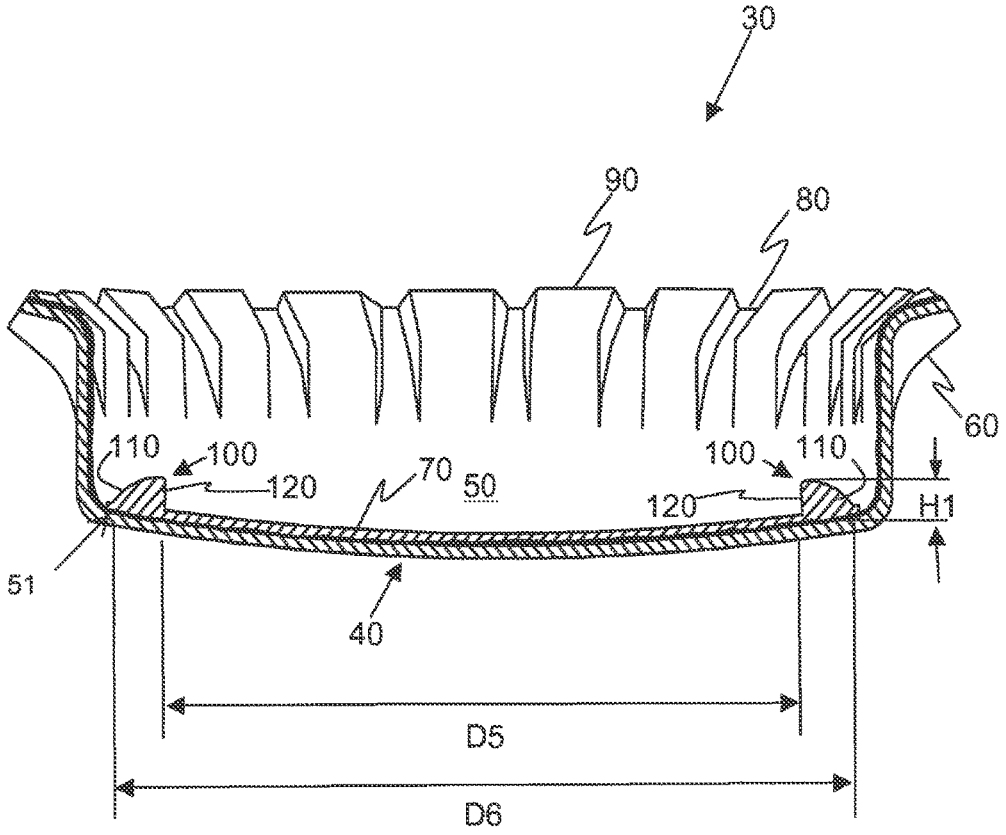
FIG. 4 shows a longitudinal sectional view of a crown-type metal cap according to the invention.

FIG. 4 shows a longitudinal sectional view of a crown-type metal cap according to the invention. The crown-type metal cap 30 is shown in its previous state before closure to seal the mouth of a bottle. The crown-type metal cap 30 is formed by a laminar part of circular plan form with an outer surface 40 and an inner surface 50, provided with a closure skirt 60 and a closure gasket 70.

The crown-type metal cap 30 of the invention is made of metal sheets, preferably steel, having a thickness with a range from approximately 0.160 mm to approximately 0.251 mm.

The outer surface 40 is optionally coated with a pigmented or non-pigmented coating and on which, by lithographic process, can be printed an advertising, for example, the brand of the drink or the bottler. In an alternative embodiment, the inner surface 50 may be coated with a pigmented or non-pigmented coating 51 which may give the crown-type metal cap 30 a distinctive character that allows to distinguish and/or identify it at a glance, from the perspective of this face, compared to other metal caps, either during manufacture, storage, distribution, marketing or once it has been discarded.

The closure skirt 60 is formed with a plurality of protrusions 80 interspersed with depressions 90 allowing its marginal folding over the mouth of a metal bottle to seal it.

The closure gasket 70 has a circular flat shape and is positioned on the inner face 50, so either it is attached or formed on the metal substrate or on the pigmented or non-pigmented coating placed on the inner face 50. The closure gasket 70 has a peripheral lip 100 which has a cross section formed of a convex arc 110 adjacent to the closure skirt 60 and a side 120 opposed to the closure skirt 60. The convex arc 110 has at least one radius of curvature, while the opposite side 120 may be a straight side or a curved side, in case this side is curved it must have a radius of curvature much larger than the radius of curvature of the convex arc 110.

The closure gasket 70 is made of thermoformable material, either PVC or PVC-free, or any other substitute material for PVC. The closure gasket 70 has an inner diameter D5 from approximately 19.05 mm to approximately 21.5 mm measured at the edge of the opposite side 120 of the peripheral lip 100 and an outer diameter D6 from approximately 23.5 mm to approximately 24.8 mm measured at the edge of the convex arc 110 of the peripheral lip 100. The peripheral lip 100 has a height H1 of approximately 0.95 mm to approximately 1.05 mm.

Figure 5A:
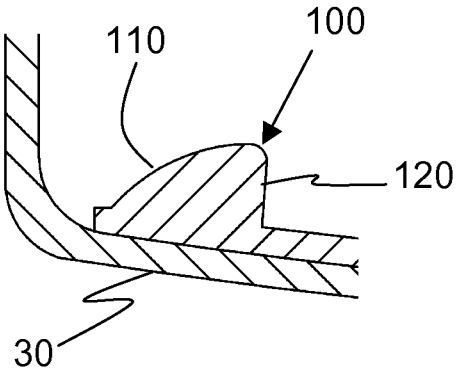
FIGS. 5A, 5B and 5C show sectional detail views of a first embodiment of a peripheral lip with one opposite side in straight line shape of a closure gasket of the crown-type metal cap according to the invention.
Figure 5B:
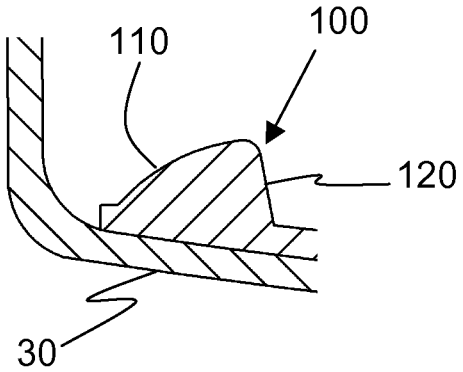
Figure 5C:
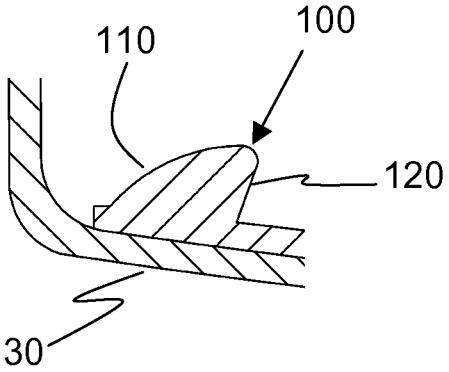

FIGS. 5A, 5B and 5C show sectional detail views of a first embodiment of a peripheral lip having one opposite side in straight shape of a closure gasket of the crown-type metal cap according to the invention. In this embodiment, the peripheral lip 100 has an opposite side 120 in straight shape forming an angle from 85° to 95° relative to the horizontal axis of the crown-type metal cap 30, with the representation of FIG. 5A at an angle of 90°, in FIG. 5B at an angle bigger than 90°, and in FIG. 5C at an angle smaller than 90°. This range of angles allows and facilitates the peripheral lip 100 to deform or bend towards the inside of the crown-type metal cap 30 to engage and seat on the curved edge of the ring 21 of the mouth of the metal bottle 20 when the crown-type metal cap 30 is positioned and sealed on the metal bottle mouth 20.

Figure 6A:
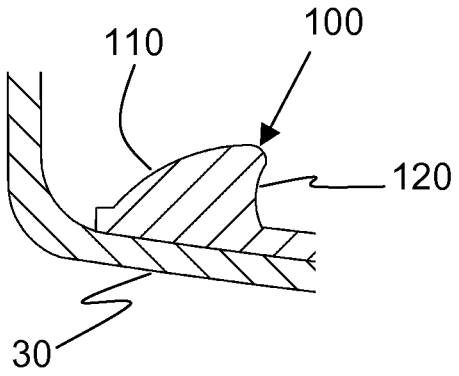
FIGS. 6A, 6B and 6C show sectional detail views of a second embodiment of a peripheral lip with one opposite side in a concave curve shape of a closure gasket of the crown-type metal cap according to the invention.
Figure 6B:
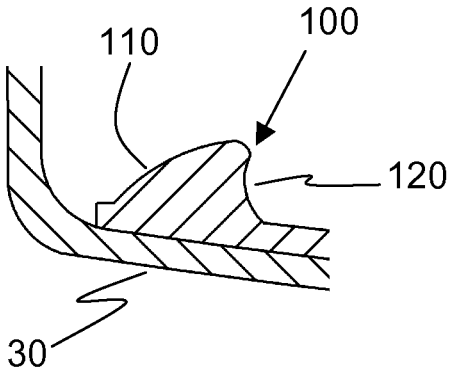
Figure 6C:
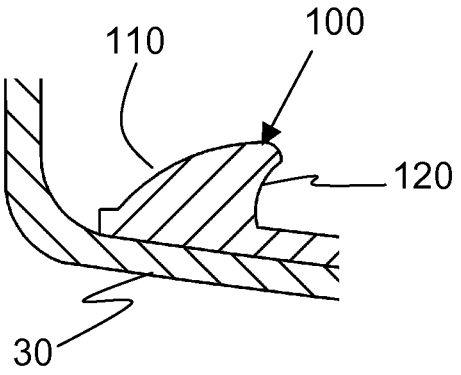

FIGS. 6A, 6B and 6C show sectional detail views of a second embodiment of a peripheral lip with one opposite side in concave curve shape of a closure gasket of the crown-type metal cap according to the invention. In this embodiment, the peripheral lip 100 has an opposite side 120 in concave curve shape with a radius of curvature greater than the radius of curvature of the convex arc 110. This radius of curvature allows and facilitates the peripheral lip 100 to deform or bend towards the inside of the crown-type metal cap 30 to engage and seat on the curved edge of the metal bottle mouth when the crown-type metal cap 30 is positioned and sealed on the metal bottle mouth.

Figure 7A:
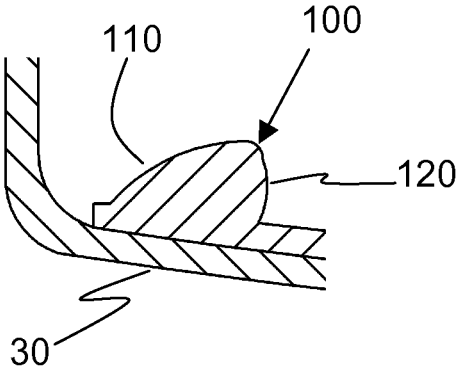
FIGS. 7A, 7B and 7C show sectional detail views of a third embodiment of a peripheral lip with one opposite side in a convex curve shape of a closure gasket of the crown-type metal cap according to the invention.
Figure 7B:
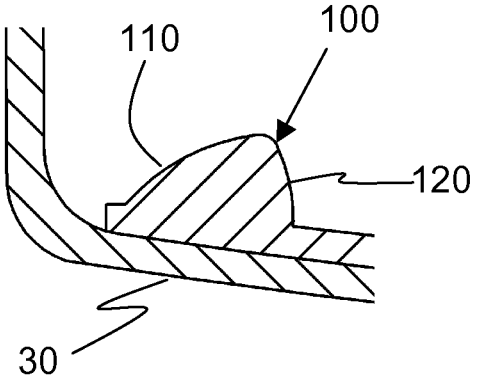
Figure 7C:
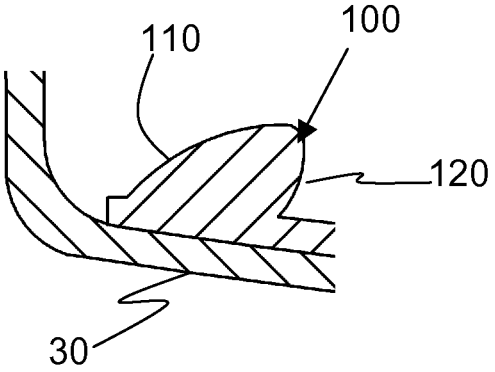

FIGS. 7A, 7B and 7C show sectional detail views of a second embodiment of a peripheral lip with one opposite side in convex curve shape of a closure gasket of the crown-type metal cap according to the invention. In this embodiment, the peripheral lip 100 has an opposite side 120 in convex curve shape with a radius of curvature greater than the radius of curvature of the convex arc 110. This range of angles allows and facilitates the peripheral lip 100 to deform or bend towards the inside of the crown-type metal cap 30 to engage and seat on the curved edge of the metal bottle mouth when the crown-type metal cap 30 is positioned and sealed on the metal bottle mouth.

Figure 8:
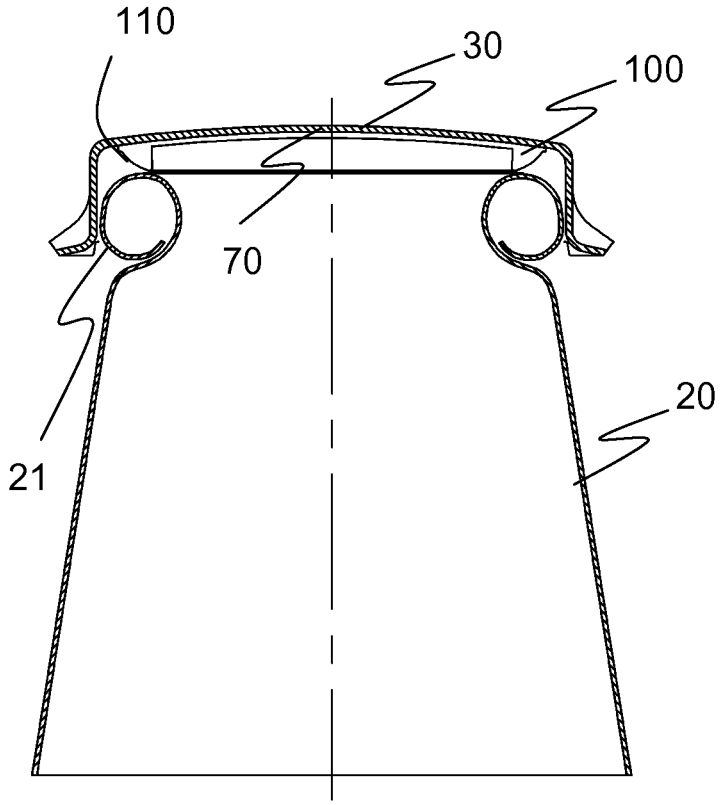
FIG. 8 shows a longitudinal sectional view of a crown-type metal cap located before sealing the mouth of a metal bottle according to the invention.

FIG. 8 shows a longitudinal sectional view of a crown-type metal cap located before sealing the mouth of a metal bottle according to the invention. At the time of positioning the crown-type metal cap 30 on the mouth of the metal bottle 20 and prior to closing, the peripheral lip 100 of the closure gasket 70, in particular its convex arc 110, sits on the inner edge of the ring 21 of the mouth of the metal bottle 20, which helps the crown-type metal cap 30 automatically to align concentrically on the mouth, thereby offsetting any irregularities present in its circular shape. This concentric alignment of the crown-type metal cap 30 is facilitated by the curvature of this convex arc 110 of the peripheral lip 100 when entering in contact with the curvature of the inner edge of ring 21 of the mouth of the metal bottle 20, providing a single contact point along the mouth of the metal bottle 20 which circumscribes a circular line between the peripheral lip 100 and the ring 21 of the metal bottle 20.

Figure 9:
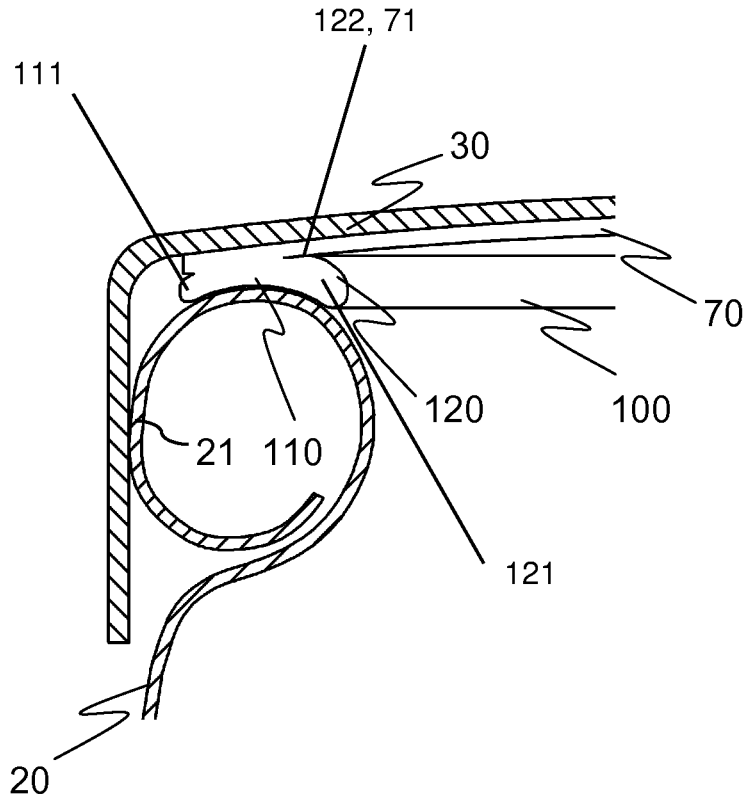
FIG. 9 shows a longitudinal sectional view of a crown-type metal cap sealing the mouth of a metal bottle according to the invention.

FIG. 9 shows a longitudinal sectional view of a crown-type metal cap sealing a mouth of a metal bottle according to the invention. When the crown-type metal cap 30 is closed on the mouth of the metal bottle 20, the peripheral lip 100 of the closure gasket 70 is deformed by crushing, thus promoting a material flow, mostly towards the center of the crown-type metal cap 30, that is, the opposite side 120 of the peripheral lip 100 is deformed into an inboard lobe 121 that has a surface 122 that touches the base surface 71 of the closure gasket 70, while the convex arc 110 of peripheral lip 100 is deformed into an outboard lobe 111 so that it adopts the curvature of the edge of ring 21 even when the edge has imperfections, thereby hermetically sealing the mouth of metal bottle 20. This phenomenon of deformation and attachment to the peripheral edge of the mouth of metal bottle 20 is facilitated by the fact that the peripheral lip 100 has an asymmetric cross-sectional shape that facilitates its deformation by displacement of the material to the side with less resistance and matter content, which in this case is the opposite side 120.

Figure 10:
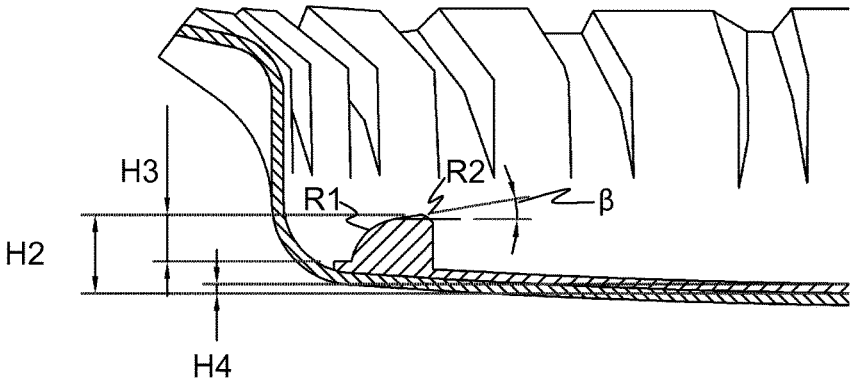
FIG. 10 shows a longitudinal sectional view of a half of a crown-type metal cap according to the invention.

FIG. 10 shows a longitudinal sectional view of a half of a crown-type metal cap according to the invention, wherein the peripheral lip 100 has a convex arc 110 defined by a major curve with a radius of curvature R1 and a minor curve with a radius of curvature R2. Radius of curvature R1 has a dimension from approximately 1 mm to approximately 1.2 mm, while radius of curvature R2 has a dimension from approximately 0.25 mm to approximately 0.29 mm, defining between the two curves, major and minor one, a stepping at an angle β from approximately 9.50° to approximately 9.60°.

The minor curve in the upper peripheral lip 100 has the function of facilitating the deformation by compression of peripheral lip 100 as well as facilitating the manufacture of the closure gasket 70, in particular including peripheral lip 100, as it prevents the formation of burrs at the moment of demolding of the tooling.

Peripheral lip 100 has a height H2 from approximately 1.65 mm to approximately 1.75 mm from the base of the closure gasket 70 to the upper edge of the convex arc 110 and a height H3 from approximately 0.95 mm to approximately 1.05 mm from the base of the peripheral lip 100 to the top of the convex arc 110. Closure gasket 70 in its central part has a thickness H4 from approximately 0.18 mm to approximately 0.22 mm.

Based on the alternatives described in these embodiments, it is considered that modifications to each of the described embodiments as well as alternative embodiments of application will be considered obvious to a person skilled in the art of the art under the present description. Therefore, it is considered that the claims cap said modifications and alternatives that are within the scope of the present invention or its equivalents.

The invention claimed is:

1. A crown-type metal cap comprising:

a circular panel, the circular panel having a configuration prior to crimping in which a cross section of the circular panel, taken along a plane that includes a center axis of the cap, consists essentially of a single arc;

a peripheral closing skirt, the peripheral closing skirt extending directly and downwardly from the circular panel, the panel and skirt being integral and formed of a metal sheet material; and a closure gasket that is in contact with an inner surface of the metal sheet material of the panel, the closure gasket including a base and a peripheral lip that extends from the base, the peripheral lip comprising an outboard surface that in cross section consists essentially of a convex arc, the convex arc defined by at least one radius of curvature, the peripheral lip further comprising an inboard surface that includes an unsealed configuration and a sealed configuration, wherein in the unsealed configuration the inboard surface in cross section includes a straight line, a curve with a radius of curvature greater than the radius of curvature of the convex arc, and/or combinations thereof, wherein said crown-type metal cap is configured to seal the mouth of a metal bottle and wherein the peripheral lip and the circular panel are configured such that, when the mouth of the metal bottle is sealed the peripheral lip is deformed such that the inboard surface of the peripheral lip is in the sealed configuration and contacts a surface of the base of the closure gasket, and wherein the cap defines a horizontal axis that extends perpendicular to the center axis of the cap and through a center of the circular panel, the inboard surface being inclined at an angle of less than 90° in relation to the horizontal axis when the inboard surface is in the unsealed configuration.

2. The crown-type metal cap of claim 1, wherein the cap defines a horizontal axis that extends perpendicular to the circular panel and through a center of the circular panel and the inboard surface extends along a straight line that is inclined from 85° to 95° in relation to the horizontal axis.

3. The crown-type metal cap of claim 1, wherein the inboard surface of the peripheral lip extends along a convex curve.

4. The crown-type metal cap of claim 1, wherein the inboard surface of the peripheral lip extends along a concave curve when the inboard surface is in the unsealed configuration.

5. The crown-type metal cap of claim 1, wherein the outboard surface of the peripheral lip extends along a major curve and a minor curve.

6. The crown-type metal cap of claim 5, wherein the major curve has a radius of curvature from 1 mm to 1.2 mm.

7. The crown-type metal cap of claim 5, wherein the major curve has a radius of curvature from 0.25 mm to 0.29 mm.

8. The crown-type metal cap of claim 1, wherein the inboard surface of the peripheral lip of the closure gasket defines an inner diameter from 19.05 mm to 21.5 mm.

9. The crown-type metal cap of claim 1, wherein the outboard surface of the peripheral lip of the closure gasket defines an outer diameter of 23.5 mm to 24.8 mm.

10. The crown-type metal cap of claim 1, wherein the peripheral lip has a height from 0.95 mm to 1.05 mm.

11. The crown-type metal cap of claim 1, wherein the circular panel has a sheet thickness from 0.160 mm to 0.251 mm.

12. The crown-type metal cap of claim 1, wherein the metal bottle is made of aluminum.

13. The crown-type metal cap of claim 1, wherein the metal sheet material includes a metal sheet and a coating such that the closure gasket is in contact with the coating of the metal sheet material.

14. The crown-type metal cap of claim 1, wherein the cross section of the outboard surface consists of the convex arc.

15. The crown-type metal cap of claim 1, wherein the convex arc is defined by two radii of curvature.

16. The crown-type metal cap of claim 1, wherein the peripheral lip consists essentially of the outboard surface and the inboard surface.

17. The crown-type metal cap of claim 15, wherein the peripheral lip consists of the outboard surface and the inboard surface.

18. A cap and bottle combination, the combination comprising:

a metal bottle having an upper edge that defines a mouth having a ring;

a crown-type metal cap that seals the mouth of the metal bottle, the cap comprising:

a circular panel, the circular panel having a configuration prior to crimping in which a cross section of the circular panel, taken along a plane that includes a center axis of the cap, consists essentially of a single arc;

a peripheral closing skirt; and a closure gasket, the closure gasket including a base and a peripheral lip that extends from the base, the peripheral lip including an outboard surface and an inboard surface, the closure gasket configured such that, when the cap is secured to the mouth, the peripheral lip is deformed between the base of the gasket and the ring of the metal bottle such that the inboard surface contacts a surface of the base of the closure gasket, and wherein the cap defines a horizontal axis that extends perpendicular to the center axis of the cap and through a center of the circular panel, the inboard surface being inclined at an angle of less than 90° in relation to the horizontal axis when the inboard surface is in the unsealed configuration.

19. The cap and bottle combination of claim 18, wherein the outboard surface and the inboard surface together define an asymmetrical cross-sectional shape.

20. The cap and bottle combination of claim 18, wherein the circular panel has a sheet thickness from 0.160 mm to 0.251 mm.

21. The cap and bottle combination of claim 18, wherein the metal bottle is made of aluminum.

22. The crown-type metal cap of claim 1, wherein the surface of the base is a first surface of the base and the peripheral lip is deformed such that a surface of the outboard side lobe contacts a second surface of the base.

23. The crown-type metal cap of claim 1, wherein the convex arc is defined by a major curve, a minor curve, and a stepping between the major curve and the minor curve.

24. The crown-type metal cap of claim 23, wherein the major curve has a radius of curvature from approximately 1 mm to approximately 1.2 mm, the minor curve has a radius of curvature from approximately 0.25 mm to 0.29 mm, and the stepping is at an angle having a range from approximately 9.50° to approximately 9.60°.

25. The cap and bottle combination of claim 18, wherein the peripheral lip has an inner diameter from approximately 19.05 mm to 21.5 mm, an outer diameter from approximately 23.5 mm to 24.8 mm, and a height of approximately 0.95 mm.

* * * * *